US007300018B2

(12) United States Patent
Malard et al.

(10) Patent No.: US 7,300,018 B2
(45) Date of Patent: Nov. 27, 2007

(54) METHOD AND DEVICE FOR STABILIZING HIGH-SPEED UNWINDING OF A STRIP PRODUCT

(75) Inventors: Thierry Malard, L'Isle Adam (FR); Marc Valence, Courbevoie (FR); Christian Viel, Houilles (FR)

(73) Assignee: Siemens Vai Metals Technologies SAS, Saint Chamond (FR)

( * ) Notice: Subject to any disclaimer, the term of this patent is extended or adjusted under 35 U.S.C. 154(b) by 273 days.

(21) Appl. No.: 10/494,358

(22) PCT Filed: Nov. 12, 2002

(86) PCT No.: PCT/FR02/03869

§ 371 (c)(1),
(2), (4) Date: May 11, 2004

(87) PCT Pub. No.: WO03/041885

PCT Pub. Date: May 22, 2003

(65) Prior Publication Data

US 2004/0245367 A1 Dec. 9, 2004

(30) Foreign Application Priority Data

Nov. 12, 2001 (FR) ..... 01 14619

(51) Int. Cl.
*B65H 23/24* (2006.01)

(52) U.S. Cl. ..... 242/615.11; 242/615.1; 242/548.3

(58) Field of Classification Search ..... 242/615.1, 242/615.11, 615.12, 548.3, 548.4, 520, 547, 242/548, 908
See application file for complete search history.

(56) References Cited

U.S. PATENT DOCUMENTS 3,335,972 A 8/1967 Jones
4,147,287 A * 4/1979 Reba ..... 226/7
4,502,231 A * 3/1985 Fissmann et al. ..... 34/114
4,893,741 A * 1/1990 Heinzmann ..... 242/615

(Continued)

FOREIGN PATENT DOCUMENTS

DE 40 37 373 C1 11/1990

(Continued)

*Primary Examiner*—Peter M. Cuomo
*Assistant Examiner*—Sang Kim
(74) *Attorney, Agent, or Firm*—Arent Fox LLP

(57) ABSTRACT

The invention relates to a method and a device for stabilizing high speed running along a longitudinal direction, of a band (4) applied on a rotary surface (3) and along which a portion of the surrounding air forms a boundary layer (43) trapped with the band (4).

According to the invention, a deflecting member (5) is placed in the dihedron (G) between the band (4) and the rotary surface (3). Said deflecting member (5) has a face (50) directed toward the band which is tilted with respect thereto and is fitted with at least one orifice (55) emerging into an inner space (51) provided inside said deflecting member (5) and connected to an outer zone. Thus, said tilted face (50) forms, with the inner face (41) of the band (4), a convergent ($C_1$) wherein the pressure increases with respect to the pressure in the inner space (51) and the differential pressure determines the exhaust of a certain air flow rate through the orifice (55) and the separation of the remaining portion of the air mass trapped in the boundary layer (43).

15 Claims, 2 Drawing Sheets

U.S. PATENT DOCUMENTS

| | | | | |
|---|---|---|---|---|
| 5,967,457 | A * | 10/1999 | Wildenberg et al. | 242/615.4 |
| 5,970,627 | A * | 10/1999 | Stenz et al. | 34/633 |
| 6,328,852 | B1 * | 12/2001 | McGary et al. | 162/199 |
| 6,375,801 | B2 * | 4/2002 | McGary et al. | 162/199 |
| 6,557,269 | B1 * | 5/2003 | Schuler et al. | 34/455 |

FOREIGN PATENT DOCUMENTS

| | | |
|---|---|---|
| DE | 198 39 916 A1 | 9/1998 |
| EP | 55-93035 | 7/1980 |
| EP | 0 130 158 A2 | 5/1984 |
| EP | 0 239 950 A1 | 3/1987 |
| EP | 0 812 685 A1 | 6/1997 |
| JP | 53-112252 | 9/1978 |
| JP | 9-124194 | 5/1997 |

* cited by examiner

METHOD AND DEVICE FOR STABILIZING HIGH-SPEED UNWINDING OF A STRIP PRODUCT

CROSS-REFERENCE TO RELATED APPLICATION

This application is a National Stage entry of International Application No. PCT/FR02/03869, the entire specification claims and drawings of which are incorporated herewith by reference.

The invention relates to a method and a device enabling to stabilise and to guide a band-type product running at high speed along a longitudinal direction, in particular in a cold rolling mill for metal bands, more especially thin sheets of aluminium.

A cold rolling mill of a metal band-type product comprises, generally speaking, one or several roll stands each including two working rolls resting on back-up rolls and associated with means for controlling the running of the band between the working rolls. Generally, the band unfolds from a spool placed on a side upstream of the roll stand(s) and winds on a coiler placed on the downstream side. The installation comprises on the other hand numerous appended members such as means for inserting the band into the roll stands, means for adjusting rotary speeds of the different members and a number of deflecting rolls which may have an adjustable position and whereon the band is applied in order to be guided along a determined path.

Taking productivity, production and profitability criteria into account, a rolling mill of very thin sheets, in particular of aluminium, includes, generally, a single rolling stand operating from spool to spool, between an unwinder and a winder.

Conventionally, a roll stand comprises two standards spaced apart, between which are installed a set of rolls, for example, in the case of a quarto roll stand, two working rolls associated respectively to two back-up rolls. Each roll is rotatably mounted, at its ends, on bearings carried by chocks slidingly mounted between the stanchions of the standards of the roll stand and clamping means resting on the chocks of the back-up rolls enable to realise the reduced thickness requested on the rolled band.

A very thin thickness may be thus obtained and, for example, in the case of aluminium sheets, the thickness may range from 3 to 300 micrometers. The items of equipment of the installation must, obviously, be adapted to so thin thicknesses, in particular for winding the spool.

For exemplification purposes, FIG. 1 represents schematically a rolling mill of an aluminium sheet including a roll stand A placed between an unwinder D carrying a spool $B_1$ and a winder E whereon is formed a spool $B_2$ after passing the product M between the working rolls of the rolling stand A.

On its path between the unwinder and the winder, the band M is guided by a number of deflecting rolls D. In particular, a roll $D_1$ for measuring the flatness is placed downstream of the roll stand A in order to detect the possible defects to be corrected by acting on means for adjusting the rolling conditions. Moreover, a wrapping roll $D_2$, of adjustable level, enables to adjust the angle for winding the band on the flatness roll $D_1$. This roll $D_2$ may be moved upwards for easier engagement of the band on the winder E.

Obviously, the installation of FIG. 1 is represented only for exemplification purposes, whereas other types of installation may be used. For example, a tandem rolling may be provided in a mill including several stands placed successively on the path of the band to realise gradual reduced thickness or still reversible rolling performed alternately in both directions, the mill being associated with two coilers which operate alternately as an unwinder and as a winder. On the other hand, the rolled band may undergo a number of treatments, either upstream, or downstream of the rolling process and, in more recent installations, these various treatments should be performed on a continuous line.

However, for rolling thin sheets of aluminium, the small thickness of the metal band rolled causes particular operation of the installation since the length of a spool may be several tens of thousands of meters and the duration of a rolling pass may therefore reach several hours. Under these conditions, it is impossible to realise a reversible rolling process.

On the other hand, there is no point, as for other installations, in realising continuous assemblies since the ratio between the duration of the rolling process and the replacement duration of the spools is very high.

In practice, the single parameter whereon may be acted efficiently to increase the productivity is the speed of the rolling process and it has been sought therefore to improve the performances of the installations. In particular, for rolling thin sheets of aluminium, very high rolling speeds may be now realised, for example of the order of 2000 meters per minute, speeds of 3000 meters per minute being even contemplated.

However, at very high speeds, it becomes very difficult to ensure stability of the guiding of the band which has a tendency to float on the deflecting rolls, in particular the wrapping roll, which may lead to defects in the spool during the winding process. It is therefore necessary, in installations operating at very high speed, to detect immediately a possible guiding defect in order to bring the speed down to a level enabling to restore stable running.

But other shortcomings appear, for winding a metal band into a spool, at high speed.

It is known, indeed, that in order to be wound into contiguous spires, the band should be held under traction by the winder E. However, the traction which may be applied to a sheet of aluminium is small and, even with a usual specific traction of the order of 3 to 5 kg/mm$^2$, the traction load which ensures the application of the band on the spool wound may only be a few tens of kg and does not exceed, in practice, 200 kg.

Still, it has been observed that, at high speed, such traction is too small to ensure good application of the spires on one another and there results increased global diameter of the spool.

This phenomenon, called volume swell, biases the usual calculations of band length and of spool diameter.

To remedy this shortcoming, it has been suggested to fit the coiler with an additional roll, so-called finishing roll, which is installed on a hinged arm and rests, from the outside, on the band during the winding process.

However, it is not desirable to increase the number of rolls or devices in contact with the band since there results a risk of marking the product.

The object of the invention is to remedy such shortcomings thanks to a method and a device enabling to ensure stable running and winding of the band, even at very high rolling speeds and, thus, to increase considerably the productivity of an installation without notable modification thereof.

To solve this problem, the applicant company has studied in detail the running conditions of a band at high speed, in particular for rolling a thin sheet of aluminium and it has appeared that the difficulties met for guiding the band, the flatness measurement and the winding into a spool after the rolling process, might all be explained in that from a certain running speed, a portion of the air situated close to the band, might be trapped therewith, abutting on the obstacles placed on the path of the band such as the guiding rolls or the working rolls.

For working rolls which are driven into rotation and whereof the clamping determines the reduced thickness, such trapping of air is unimportant.

However, in the case of a deflecting roll whereon the band is simply applied under traction, the air trapped with the band causes, upstream of the application zone, a dynamic pressure which, by a wedging effect, is capable of lifting the band slightly. This is even more sensitive as when rolling thin sheets of aluminium since, as seen above, the traction load which determines the application of the band on the roll, is necessarily limited.

There forms then, between the sheet and the roll, an air cushion which, in the case of a deflecting roll or a wrapping roll, may disturb the guiding of the band, the latter being slightly lifted and liable therefore to move laterally.

Such an air cushion formation phenomenon by air trapping between a band running at high speed and a deflecting roll or a spool had already been observed in the paper industry.

To avoid this shortcoming, it has been suggested, in the document DE-A-19839916, to place in the dihedron formed upstream of the line of contact, a flexible blade which enters the interval between the inner face of the band and the spool and brakes the air stream, the pressure upstream of the line of contact being thus diminished.

It has also been observed, in the case of a cool-down roll for an offset printing machine, that the paper band may drive a certain amount of air which might enter between the band and the roll, the air cushion thus formed constituting an insulating layer which reduces the cool-down effect.

To avoid this shortcoming, it has been suggested, in the document EP-A-0812695, to place in the upstream dihedron between the band and the roll a suction device in the form of a hollow caisson connected to a suction fan and having a flat face and a curved face, respectively parallel to the band and to the roll, which converge to a narrowed end along which is provided a slot which emerges therefore between the band and the roll, close to the line of contact. The air situated in this portion is therefore sucked in by this slot and the pressure upstream of the line of contact is diminished, the band being thus held applied on the roll, without any risk of being lifted.

As it has been noted that the various shortcomings mentioned above in the case of the metal band rolling at very high speed result from the air trapping effect with the band, it has been suggested that the devices provided previously, in the paper industry, to avoid this shortcoming, might advantageously be used for metal band rolling at high speed.

It has appeared, however, that the devices known previously and either simply braking, or sucking in the air trapped, would not be efficient enough or even harmless, in the case of a metal sheet, in particular of aluminium.

Indeed, as indicated above, because of the very thin thickness of the aluminium sheets, the traction load which may be applied is relatively small and a suction nozzle placed close to the line of contact between the band and the spool might deflect the band which, when resting against the suction member, might be damaged or even torn.

Detailed studies have therefore related to the aerodynamic conditions of air circulation to develop a device which, without requiring air suction liable to deflect the band, causes stratified phenomenon acting only on the boundary layer of air trapped with the band.

The invention relates therefore generally speaking, to a method and a device for stabilising high speed running, along a longitudinal direction of a band being applied from a line of contact, over at least one angular sector of a rotary revolution surface around an axis crosswise to the running direction, and connecting tangentially to the rotary surface while forming, on the upstream side in the running direction, a dihedron delineated, on one side by an outer face of the rotary surface and on the other side, by an inner face of the band along which a portion of the surrounding air forms a boundary layer trapped with the band toward the line of contact, a deflecting member being placed in the dihedron in order to modify the conditions of circulation of the air trapped with the band, said deflecting member having a first face directed toward the inner face of the band and a second face directed toward the outer face of the rotary surface.

According to the invention, at least the first face of the deflecting member is tilted toward the inner face of the band, in the running direction thereof and is fitted with at least one orifice emerging into an inner space provided inside the deflecting member and connected to an outer zone, said tilted face forming, with the inner face of the band, a convergent wherein the pressure increases with respect to the pressure in the inner space), the differential pressure determining the exhaust, through the orifice of the tilted face and the inner space, of a certain air flow rate and the separation of the remaining portion of the air mass constituting the boundary layer trapped with the band.

Particularly advantageously, the inner space of the deflecting member is not connected to a suction fan, but simply to an outer zone situated at atmospheric pressure, the circulation of the air taking place thus naturally, without true suction, at the deflecting member.

Preferably, the second face of the deflecting member, directed toward the rotary surface, is tilted with respect thereto, in order to form a convergent determining an increase in pressure of the air trapped with the rotary surface, whereof a portion is evacuated toward the outer zone connected to the inner space passing through at least one orifice provided in said second face.

Such a stabilisation device according to the invention may be applied either to a deflecting roll with a cylindrical profile determining a change in direction of the running plane of the band, or to winding the band into a spool in order to prevent the trapping of air between the superimposed spires.

For winding into a spool, the deflecting member of the air consists of a hollow profile, installed on a supporting means adjustable relative to the diameter of the spool, in order to maintain the deflecting member in optimum position with respect to the inner face of the band, as the latter is wound gradually into a spool.

Preferably, this supporting arm of the deflecting member of the air exhibits a variable length and is rotatably mounted around an axis parallel to the axis of the spool, said arm being associated with means for adjusting its orientation and its length relative to the diameter of the spool, to position the profiled member inside the upstream dihedron.

Advantageously, the adjustable supporting means of the deflecting member is installed on a wrapper associated with the spool for easier beginning of the band winding process, the supporting means being folded in the jig of the wrapper when the latter is at the beginning of the winding position and unfolded after winding a few spires and moving the wrapper away, in order to place the deflecting member close to the line of contact, at the end of the upstream dihedron.

The invention also relates to the use, in a rolling mill for metal bands, in particular of aluminium, of such a stabilisation device which may be placed upstream of at least one deflecting roll, in order to direct application of the band on the roll without interposition of a air layer. This deflecting roll may advantageously be a flatness measuring roll, the device then enabling not to disturb the measuring process by trapping air between the band and the roll.

But the invention may also be used advantageously for winding the rolled band on a coiler placed at the end of the line, the stabilisation device being then placed upstream of the line of contact with the spool already wound in order to avoid any volume caused by the air trapped between the spires and to ensure guiding stability of the band during the winding process.

Other advantageous characteristics are mentioned in the claims.

But the invention will be understood better by the following description of certain embodiments given for exemplification purposes and represented on the appended drawings.

Figure 1:
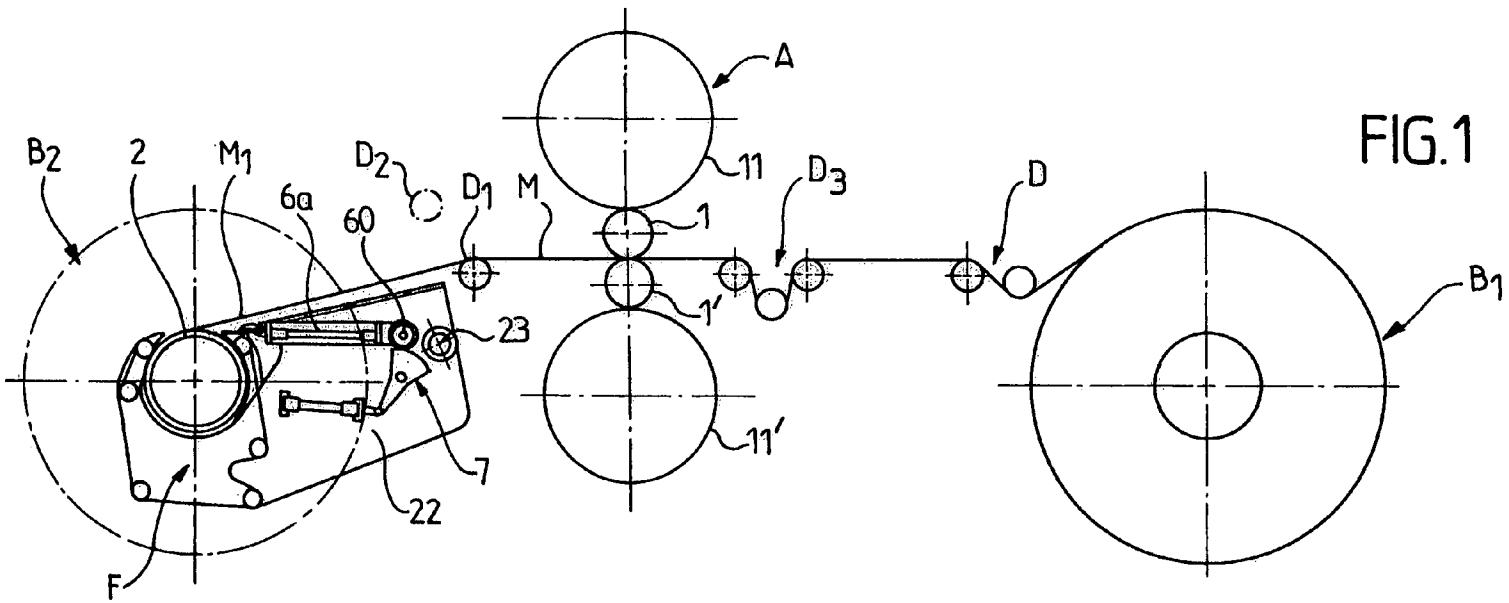
FIG. 1 is a diagrammatical view of a thin sheet rolling mill.

As indicated above, FIG. 1 shows, schematically, the whole rolling mill of a sheet of aluminium which unfolds from a spool $B_1$ and is re-wound, at the outlet of the mill A to form a new spool $B_2$. The band M is guided by a plurality of deflecting rolls which ensure stable running, in particular, a roll for measuring the flatness $D_1$ and a wrapping roll $D_2$.

Moreover, a loop yarn twister $D_3$ composed of two fixed rolls surrounding a central roll of adjustable level, enables to adjust the tension upstream of the mill A.

Figure 3:
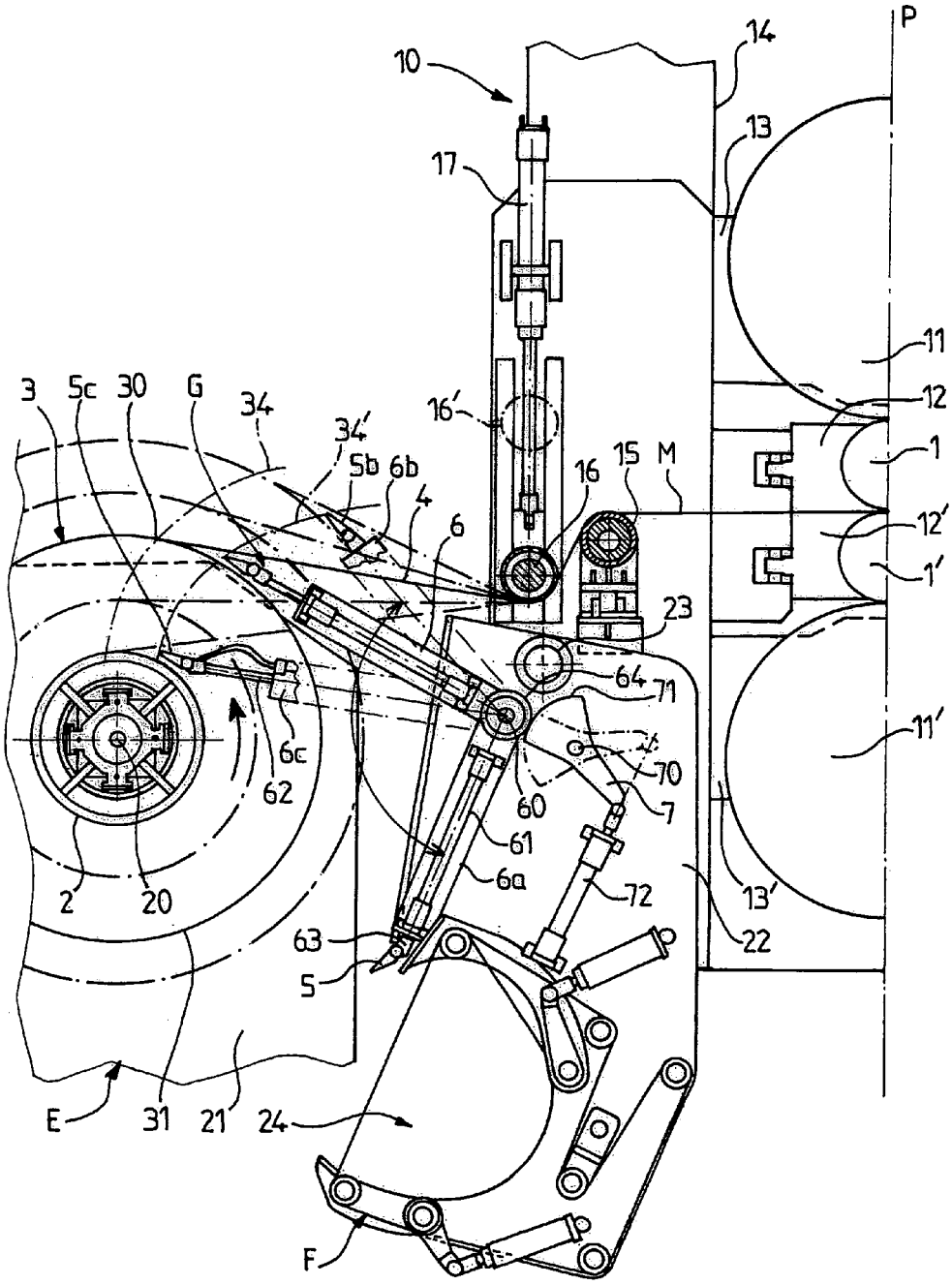
FIG. 3 shows, in elevation, the whole device fitted on a winder placed at the outlet of a mill.

The mill A represented schematically on FIG. 1 and more in detail on FIG. 3, may be, for example, of quarto type including two working rolls 1, 1' resting, respectively, on back-up rolls 11, 11' and each revolving round a shaft carried, at its ends, by chocks, respectively 12, 12', 13, 13' which are slidingly mounted along vertical guiding faces 14 provided on two fixed standards 10 constituting the roll stand of the mill.

Downstream of the mill, the band passes successively over a roll 15 for measuring the flatness and on a wrapping roll 16 which is slidingly mounted on both standards 10 of the roll stand and whereof the position may be adjusted by a jack 17 relative to the nature of the metal and to the thickness of the band, in order to adjust the angle of application on the flatness roll 15.

The winder E whereon is formed the rolled spool $B_2$ comprises, conventionally, an extensible mandrel 2 mounted cantilever on a chassis 21 and driven into rotation round its axis 20. In a well-known fashion, as shown on FIGS. 1 and 3, the winder E is associated with a wrapper F installed on a chassis 22 hinged on the standards 10 of the mill around an axis 23 parallel to the running plane of the band M and which may revolve, under the action of a means not represented, between a lifted position and a position spaced apart. The wrapper F comprises an open portion 24 which, in the lifted position of the chassis 22, engages on the mandrel 2 of the winder E.

At the beginning of the rolling process, the wrapping roll 16 is raised by the jack 17 in a position spaced apart 16' letting through the head $M_1$ of the band M and its engagement on the mandrel 2. Known means, provided in the open portion 24 of the wrapper F and not represented on the Figure, pick up the head of the band for easier beginning of the winding process into superimposed spires. When the number of spires is sufficient to support the traction of the band, the wrapper F is moved away by the jack 24 to adopt the position represented on FIG. 3.

A spool 3 is thus formed on the mandrel 2, whereof the diameter increases gradually, as indicated on FIG. 3.

The band M connects therefore tangentially to the spool 3, along a line of contact 30 parallel to the axis 20 of the mandrel 2, while forming a dihedral angle G with the outer face 31 of the spool 3, directed upstream with respect to the running direction.

It is known that high speed displacement, parallel to itself, of a thin surface in a fluid causes, by friction, trapping of the molecules of the fluid, for example the surrounding air, situated in close vicinity of the band in motion.

Figure 2:
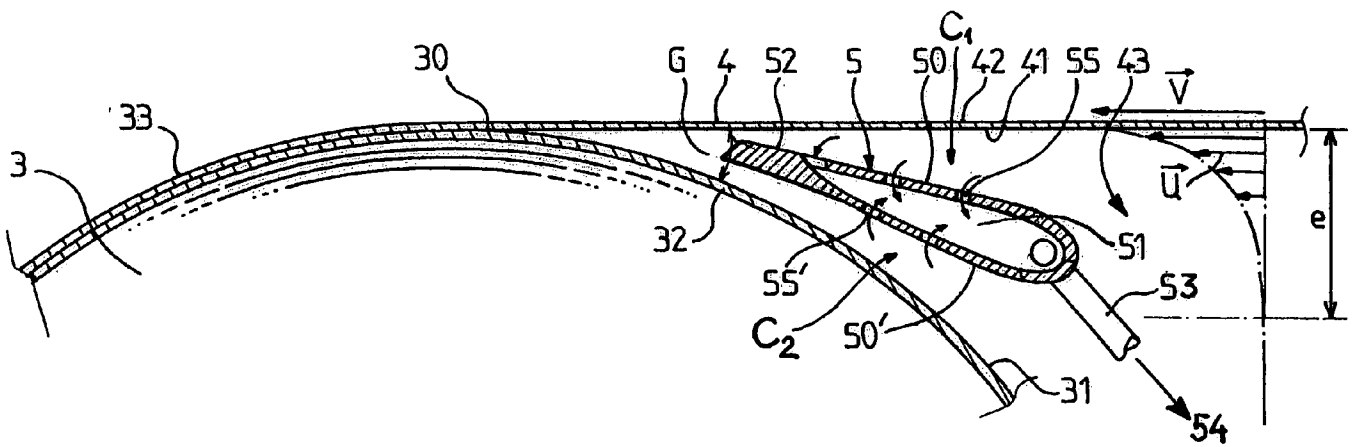
FIG. 2 is a cross-sectional view, at enlarged scale, of a deflecting member of the air according to the invention, applied to the winding of a spool.

FIG. 2, for example, shows with an enlarged scale the zone for winding the band M on the spool 3, and represents, on the right-hand side, the variation diagram of the speed vector (U) of the air which, from a distance (e) from the inner face 41 of the band 4 goes from a zero value to the value (V) of the running speed of the band 4, while remaining parallel to itself. There exists therefore, along the inner face 41 of the band 4 directed toward the spool 3, a thickness of air in motion 43 called boundary layer wherein a stratified flow takes place at a speed which increases gradually, while getting closer to the band 4, to reach the speed thereof along its inner face 41. The same goes along the outer face 42 of the band.

This boundary layer 43 accompanies the band 4 in its running direction and abuts against the spool 3 whereof the outer face 31 directed upstream, i.e. facing the running direction, forms, with the inner face 41 of the band 4, a dihedron G which converge toward a line of contact 30 of the band 4 with the last spire wound 32.

This blocking, upstream of the line of contact 30, of the air trapped along the face 41 of the band determines an increase in pressure which may cause slight lifting of the band 4 and the introduction of a fine air layer between the inner face 41 of the band 4 and the spool 3.

The idea of the invention consists in providing aerodynamic conditions of air circulation in the upstream dihedron G enabling to separate the boundary layer 43 upstream of the line of contact 30.

This separation of the boundary layer 43 is performed by evacuating toward the outside a portion of the air flow rate trapped with the band, by means of a deflecting member 5 placed in the upstream dihedron G and extending between the inner face 41 of the band and the outer face 31 of the spool, parallel to the line of contact 30. This deflecting member 5 consists of a hollow profile having at least one face 50 directed toward the inner face 41 of the band 4 and tilted with respect thereto, in the running direction, in order to form a convergent $C_1$ whereof the section diminishes gradually by causing an increase in pressure of the air trapped with the band in the boundary layer 43.

This tilted face 50 is fitted with a plurality of orifices in the form of slots 55 which emerge in the inner space 51 provided inside the hollow profile 5. The latter is closed at its ends and fitted with an orifice linked by a conduit 53 to an outer zone 54 located, for example, at atmospheric pressure.

The increase, by a wedging effect, in pressure in the convergent $C_1$ determines therefore the passageway through the slots 55 for a portion of the air trapped in the boundary layer 43 which escapes through the conduit 53 toward the zone at smaller pressure 54. The flow rate of air trapped toward the line of contact 30 diminishes and the boundary layer 43 thus comes loose from the inner face 41 of the band 4 to be attached to the tilted face 50 of the deflecting member 5 while forming a stream of stratified flow which escapes through the slot 55 and the conduit 53.

The pressure of the trapped air increases only up to the downstream end of the deflecting member 5 and then decreases. The pressure being smaller upstream of the line of contact 30, the air should not enter between the last spire 32 of the spool 3 and the spire 33 being formed.

In the preferred embodiment represented on FIG. 2, the second face 50' of the deflecting member 5 directed toward the winding surface 3 is also tilted with respect thereto in order to form a second convergent $C_2$ which increases gradually the pressure of the air trapped by the rotation of the spool 3. This second tilted face 50' is also fitted with a slot 55' which emerges in the inner space 51 of the hollow profile 5.

There is thus a natural circulation along both faces 50, 50' of the hollow profile 5 which diminishes the pressure at the end of the dihedron G, upstream of the line of contact 30, without any air suction at the end 52 of the deflecting member 5 which enters the dihedron G between the inner face 41 of the band and the face 31 of the spool 3. It should be noted that it is needless to taper the end 52 of the deflecting member 5 which must simply limit both convergents $C_1$, $C_2$ to determine the stratified air flow along both tilted faces 50, 50' without extending toward the line of contact 30.

To determine such stratified flow, it is sufficient, normally, that the conduit 53 emerges simply in a calm zone where the air speed is zero and the pressure is equal at atmospheric pressure.

Indeed, the differential pressure between both convergents $C_1$, $C_2$ and the outlet 54 of the exhaust conduit 53 determines natural air circulation through the slots 55, 55'.

However, if the width of the band and, consequently, the length of the profile 5 as well as the length of the exhaust conduit 55 are too great and might cause high loss of pressure, taking the dynamic overpressure into account due to the rotary speed of the spool, it may be preferable to link the exhaust conduit 53 to a suction device. However, the aim of the latter is simply to compensate the loss of pressure in the circuit and not to realise true air suction in the apex of the dihedron downstream of the deflecting member 5. The band therefore cannot be damaged by application thereof on the downstream end 52 of the deflecting member 5, even in the case where the band is subjected to relatively small traction load.

The shape of the hollow profile 5, in particular the profile and the tilting of the faces 50, 50' and their optimum positioning with respect to the band to be wound 4 and the line of contact 30 may be determined empirically or by calculation in order to obtain the effect sought, while studying the conditions of air circulation taking into account the running speed v of the band 4, and losses of pressure in the profile 5 and the exhaust circuit.

On the other hand, the diameter of the spool and, consequently, the position of the line of contact 30 and the orientation of the band 4 varies obviously, during the winding process. The position of the deflecting member 5 should be maintained permanently inside the dihedron G and, to do so, it is advantageous to use the device represented in detail on FIG. 3.

As indicated above, at the outlet of the mill, the rolled band M passes over two deflecting rolls, respectively, a flatness measuring roll 15, placed at the gap between the working rolls 1, 1' and a wrapping roll 16 which is slidingly mounted along guiding rails provided on the standards 10 of the mill and whereof the level may be adjusted by means of a jack 17 relative to the thickness and to the nature of the rolled band, the wrapping roll 16 being raised in high position 16' at the beginning of the rolling process for easier passage of the head of the band M and its engagement on the mandrel 2 of the winder E. On the other hand, the latter is associated with a wrapper F installed on a chassis 22 which may revolve round an axis 23 between a raised position, represented on FIG. 1, for which the wrapper is engaged on the mandrel 2 for easier start of the winding process and a lowered position, represented on FIG. 3, for which the wrapper is moved away from the mandrel 2 to enable the winding of the band and the formation of the spool 3. The latter increases in diameter with the winding process and as the line of contact 30 of the band M with the spool 3 moves away therefore from the winding axis 20 by following a curve 34 represented as a dotted line on FIG. 3.

As indicated, the deflecting member 5 must follow an increase in diameter of the spool while remaining in optimum position inside the dihedron G to enable the air trapped in the boundary layer to escape.

The deflecting member 5 must therefore follow a curve 34' analogue to the path 34 of the line of contact 30 by moving apart, however, slightly thereof to take into account the fact that the dihedron G closes gradually with the winding process.

Therefore the position of the deflecting member 5 relative to the diameter of the spool 3 may be determined by calculation or empirically.

To enable gradual displacement of the deflecting member 5, the latter is installed at the end of a support 6 whereof the orientation and the length may vary relative to the diameter of the spool 3.

As shown on FIG. 3, the support 6 may be composed of two arm spaced apart, arranged at both ends of the profile 5 constituting the deflecting member and liable to rotate round a shaft 60, hinged at its ends, on both sides of the chassis 22 of the wrapper F.

Each arm 6 carries the body of a jack 61 whereof the stem 62 is fitted, at its end, with an attachment part 63 of the hollow profile 5. The latter is linked by a flexible hose at a fixed pipework on the supporting arm 6 for the air sucked in to escape through the slots 55, 55'.

The chassis 22 of the wrapper F carries on the other hand a member 7 for controlling the rotation of the support 6, composed of at least one lever hinged round an axis 70 and carrying a toothed sector 71 which engages a toothed pinion 64 rotatably interconnected with one of both arms which form the support 6 and are interconnected in rotation. The other branch of the lever 7 is hinged on the stem of a jack 72 resting on the chassis 22 and which controls thus the rotation of the support 6 between a retracted position **6*a*, and a position spaced apart 6*b* corresponding to the maximum diameter of the spool 3**.

In the retracted position **6*a* which is also represented on FIG. 1, the profile 5 and both its supporting arms are folded in the jig of the chassis 22 of the wrapper F and do not disturb therefore the positioning of the latter on the mandrel 2** for starting the winding process.

After winding into a sufficient number of spires to place the band M under the traction necessary to the rolling process, the control member 7 rotates both supporting arms 6 until a position 6*c* for which the axis of the jack 61 is substantially tangent to the spool at the beginning of the winding process and the stem of the jack is brought forward in order to place the deflecting member in the requested position 5*c* close to the inner face of the band 4. The rotary speed of the mandrel 2 is then increased up to the level corresponding to the rolling process at high speed of the band 4.

Using easy-to-design hydraulic means, the jacks 72 controlling the rotation of the arm 6 and 61 adjusting the radial position of the deflecting member 5 are slaved to the variation in diameter of the spool 3 in order to follow the curve 34' while remaining at the distance requested from the inner face 41 of the band 4 and as close as possible to the line of contact 30.

To this effect, the jacks 61 and 72 are fitted with position sensors and controlled by an appropriate circuit in order to adjust with accuracy the position of the profile 5 relative to the diameter of the spool which is determined itself on the basis of the number of turns of the mandrel 2 while taking into account the thickness of the band 4.

The installation is fitted, to do so, with sensors and with calculation means which may be programmed in order to determine the profile of the curve 34' followed by the deflecting member 5.

Obviously, it is also necessary to take into account the position of the wrapping roll 16 which determines the angle of application of the band 4 on the spool 3 and the position of the line of contact 30.

When the diameter of the spool reaches its maximum value, the arm 6 adopts the position 6*b*, the stem 62 of the jack being retracted completely.

Upon completion of the winding process, the spool 3 is withdrawn and the rotary support 6 is folded in its position 6*a* inside the jig of the wrapper F. The latter may then be raised to engage on the mandrel 2, in order to start the winding process of a new spool.

The invention which has just been described in the case of a spool winder may also be applied to a deflecting roll, for example, the roll intended for measuring the flatness 15. The band M is then applied under traction on an angular sector of the roll 15 and the deflecting member 5 is placed, as previously, in the dihedron G between the band 4 during the winding process and the portion of the surface of the roll 15 placed upstream of the line of contact 30.

The deflecting roll 15 having constant diameter, the deflecting member 5 remains in the same position with respect to the roll and may be placed, for example, at the end of a fixed supporting arm.

As previously, the deflecting member 5 may be a hollow profile emerging into an exhaust conduit 53, toward the outside, of a portion of the air trapped in the boundary layer 43 in order to reduce the dynamic pressure at the end of the dihedron G, at the line of contact 30. One avoids thus the formation of an air cushion which, on the one hand, might cause lateral floating of the band on the deflecting roll and on the other hand, in the case of a flatness roll, might disturb the measurement.

The reference signs inserted after the technical characteristics mentioned in the claims, solely aim at facilitating the understanding thereof and do not limit their extent whatsoever.

The invention claimed is:

1. A method for stabilising high speed running of a metal band along a longitudinal running direction, the band (4) being applied from a line of contact (30), over at least one angular sector of rotary revolution surface (3) around an axis (20) crosswise to the running direction, and connecting tangentially to the rotary surface (3) while forming, on the upstream side in the running direction, a dihedron (G) delineated, on one side by an outer face (31) of the rotary surface (3) and on the other side, by an inner face (41) of the band (4) along which a portion of the surrounding air forms a boundary layer (43) trapped with the band (4) toward the line of contact (30), a the method comprising positioning a device upstream of a spool (3) for winding the band into superimposed spires, in order to prevent the trapping of air between the spires (31, 32), providing the device as a hollow deflecting member (5) having a hollow profile;

modifying the conditions of circulation of the air in the upstream dihedron (G) the hollow deflecting member (5) having a first face (50) directed toward the inner face (41) of the band (4) and a second face (50') directed toward the outer face (31) of the rotary surface (3), tilting the first face (50) of the deflecting member (5) toward the inner face (41) of the band (4), in the running direction thereof, in order to decrease gradually the passageway section of the air trapped with the band, along the inner face (41) thereof, thereby causing an increase in the pressure of the air trapped in the convergent ($C_1$) thus formed, with respect to the pressure prevailing inside the hollow deflecting member (5) which communicates with the convergent $C_1$ by at least one orifice (55) provided in said tilted face (50) and with the outside, the differential pressure thus created determining the exhaust toward the outside of a certain air flow rate passing through said orifice (55) and the separation of the remaining portion of the air mass constituting the boundary layer (43), installing the deflecting member (5) of the air on a supporting means (6) adjustable in length and angle relative to the diameter of the spool (3), and maintaining the deflecting member (5) in an optimum position with respect to the inner face (41) of the band (4), as the band is wound gradually onto the spool.

2. A method for stabilising a metal band according to claim 1, wherein the second face (50') of the deflecting member (5) is tilted toward the rotary surface (3), in the rotary direction thereof, in order to generate, by a converging effect, an increase in pressure along said second face (50') and the exhaust of a portion of the air trapped with the rotary surface (3), toward a lower pressure zone, passing through at least one orifice (55') provided in said second face (50').

3. A device for stabilising high speed running along a longitudinal direction, of a metal band (4) being applied from a line of contact (30), over at least one angular sector rotary revolution surface (3) around an axis (20) crosswise to the running direction, and connecting tangentially to the rotary surface (3) while forming, on the upstream side in the running direction, a dihedron (G) delineated, on one side by an outer face (31) of the rotary surface (3) and on the other side, by an inner face (41) of the band (4) along which a portion of the surrounding air forms a boundary layer (43) trapped with the band (4) toward the line of contact (30), said device being arranged upstream of a spool (3) for winding the band into superimposed spires, in order to prevent the trapping of air between the spires (31, 32), comprising a deflecting member (5) being placed in the dihedron (G) in order to modify the conditions of circulation of the air trapped with the band (4), said deflecting member (5) having a first face (50) directed toward the inner face (41) of the band (4) and a second face (50') directed toward the outer face (31) of the rotary surface (3), wherein, at least the first face (50) of the deflecting member (5) is tilted toward the inner face (41) of the band (4), in the running direction thereof and is fitted with at least one orifice (55) emerging into an inner space (51) provided inside the deflecting member (5) and connected to an outer zone, said tilted face (50) forming, with the inner face (41) of the band (4), a convergent ($C_1$) wherein the pressure increases with respect to the pressure in the inner space (51), the differential pressure determining the exhaust, through the orifice (55) and the inner space (51), of a certain amount of air and the separation of the remaining portion of the air mass trapped in the boundary layer (43), and wherein the deflecting member (5) of the air comprises a hollow profile, installed on a supporting means (6) adjustable in length and angle relative to the diameter of the spool (3), for maintaining the deflecting member (5) in optimum position with respect to the inner face (41) of the band (4), as the band is wound gradually into the spool.

4. A device according to claim 3, wherein the inner space (51) of the hollow deflecting member (5) is connected to an outer zone (54) situated outside the upstream dihedron (G), at a pressure lower than the pressure (P) in the convergent ($C_1$) at the inlet orifice (55).

5. A device according to claim 4, wherein the inner space (51) of the deflecting member (5) is directly connected to an outer zone situated at atmospheric pressure.

6. A device according claim 3, wherein the second face (50') of the deflecting member (5), directed toward the rotary surface (3), is tilted with respect thereto, forming a convergent and determining an increase in pressure of the air trapped with the rotary surface (3), whereof a portion is evacuated toward the outer zone (54) connected to the inner space (51) passing through at least one orifice (55') provided in said second face (50').

7. A stabilisation device according to any of the claims 3 to 6, wherein the revolution surface whereon the band is applied is a deflecting roll (D) with a cylindrical profile, determining a change in direction of a running plane of the band (M).

8. A device according to claim 3, wherein the supporting means for maintaining the profiled deflecting member (5) of the air comprises at least one supporting arm (6) having a variable length and rotatably mounted around an axis (60) parallel to the axis (20) of the spool (3) with the deflecting member of the air being installed on an end thereof, and a means for adjusting (7) orientation and (61) length of said at least one supporting arm, relative to the diameter of the spool (3), to position the profiled member (5) inside the upstream dihedron (G).

9. A device according to claim 8, wherein the supporting arm (6) carries a first hydraulic jack (61) having a first element attached to the arm (6) and a second element (62) slidingly mounted on the first element and carrying the deflecting member (5), the position of the second element (62) with respect to the first (61) being adjusted relative to the diameter of the spool (3).

10. A device according to claim 8, wherein the means for adjusting the orientation of the supporting arm comprises a lever (7) rotatably connected to the supporting arm (6) and whereof the angular position is adjusted by a second hydraulic jack (72).

11. A device according to claim 10, wherein the lever (7) is rotatably mounted around an axis (70) parallel to the axis of rotation (60) of the supporting arm (6) and is interconnected with a toothed sector (71) with a circular profile centred round the axis (70) of the lever (7) of the crank and engaging a toothed wheel (64) rotatably interconnected with the supporting arm (6).

12. A device according to claim 3, wherein the supporting means (6) for adjusting the deflecting member is installed on a wrapper (F) associated with the spool (3) for easier beginning of the winding thereof, the supporting means (6) being folded in a jig of the wrapper (F) when the wrapper is at the beginning of the winding position and unfolded after winding a few spires and spacing the wrapper apart (F), in order to place the deflecting member (5) close to the band (M), in the upstream dihedron (G).

13. A use of a stabilisation device according to any of the claims 3 to 6, in a rolling mill for a metal band, the stabilisation device (5) being arranged upstream of at least one deflecting roll (D) placed on the path of the band, in order to ensure direct application of the band on the roll without interposition of an air layer capable of disturbing the guiding of the band.

14. A use of a stabilisation device according to claim 6, in a rolling mill for a metal band including at least one rolling stand (10) associated with a roll (15) for measuring the flatness whereon the band is applied under traction, the stabilisation device (5) being arranged upstream of the flatness roll (15) in order to prevent the trapping, between the band (M) and the roll (15), of an air layer capable of disturbing the flatness measurement.

15. A use of a stabilisation device according to claim 3, in a rolling mill for a metal band (M) including a winder (E) placed at the end of the line, the stabilisation device (5) being placed in the dihedron (G) upstream of the line of contact (30) with the band (4) already wound in order to prevent the trapping of air between the spires (31, 32) and to ensure guiding stability of the band (4) during the winding process.

* * * * *